US006594542B1

(12) United States Patent
Williams

(10) Patent No.: US 6,594,542 B1
(45) Date of Patent: Jul. 15, 2003

(54) METHOD AND SYSTEM FOR CONTROLLING CHEMICAL MECHANICAL POLISHING THICKNESS REMOVAL

(75) Inventor: Roger O. Williams, Paradise Valley, AZ (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/297,223

(22) PCT Filed: Oct. 3, 1997

(86) PCT No.: PCT/US97/18346

§ 371 (c)(1),
(2), (4) Date: Oct. 18, 1999

(87) PCT Pub. No.: WO98/14306

PCT Pub. Date: Apr. 9, 1998

Related U.S. Application Data

(60) Provisional application No. 60/027,833, filed on Oct. 4, 1996.

(51) Int. Cl.[7] ..... G06F 19/00; B24B 37/04

(52) U.S. Cl. ..... 700/164; 156/345.13; 438/692; 438/959; 451/5

(58) Field of Search ..... 700/121, 164, 700/175, 174, 173; 451/5, 21, 6, 287; 438/8, 5, 14, 692, 959, 16; 156/345, 345.12, 345.13, 345.15, 345.16, 345.24, 345.25; 324/76.33

(56) References Cited

U.S. PATENT DOCUMENTS 4,982,150 A * 1/1991 Silverstein et al. ..... 324/76.33
5,664,987 A * 9/1997 Renteln ..... 451/21
5,695,601 A * 12/1997 Kodera et al. ..... 438/16
5,705,435 A * 1/1998 Chen ..... 156/345
5,948,203 A * 9/1999 Wang ..... 156/345
6,157,078 A 12/2000 Lansford ..... 257/734
6,291,253 B1 9/2001 Lansford et al. ..... 438/14

FOREIGN PATENT DOCUMENTS

EP 0375921 * 7/1990

* cited by examiner

*Primary Examiner*—Leo Picard
*Assistant Examiner*—Steven R. Garland
(74) *Attorney, Agent, or Firm*—Moser, Patterson & Sheridan

(57) ABSTRACT

An improved method and apparatus for controlling the depth of removal by chemical mechanical polishing of a selected material on a supporting semiconductor underlayer where it is desired to terminate removal of the selected material, such as silicon oxide, at a specified depth. In accordance with at least some embodiments of this novel method and system, the selected material, such as a surface oxidization layer, is polished to initiate removal thereof in the direction of the material-underlayer interface.

This system includes three primary components: a chemical mechanical wafer polishing machine, a semiconductor thin film thickness measurement device, and statistical signal process algorithm and its associated computer system provides a chemical mechanical polishing system control by analysis and prediction of the current and future removal rates based on performance of past ratios for the before and after semiconductor thin film thickness measurements.

6 Claims, 5 Drawing Sheets

CMP Process Disturbance

Predicted CMP Sequence Characterization

PERRFECT Correction Graph

METHOD AND SYSTEM FOR CONTROLLING CHEMICAL MECHANICAL POLISHING THICKNESS REMOVAL

CROSS-REFERENCE TO RELATED APPLICATIONS

The present application hereby claims priority to copending U.S. provisional application Serial No. 60/027,833, which was filed on Oct. 4. 1996.

The present application is related to U.S. Pat. No. 5,908, 530, issued Jun. 1, 1999, which is hereby incorporated by reference in its entirety.

TECHNICAL FIELD

This invention relates in general to a system and method for controlling material removal rates during polishing; and, in particular, for controlling thickness removal during chemical mechanical polishing using detection, statistical estimation, and time series analysis.

BACKGROUND ART

Increasingly, chemical mechanical polishing (CMP) is becoming the methodology of choice to polish certain articles of manufacture that require a desired degree of planarization, such as semiconductor wafers from which chips for integrated circuits are processed. Generally, CMP employs a polishing system for processing such a wafer by polishing on one surface thereof by a procedure which includes engagement of the semiconductor wafer face with a polishing pad and a method of controlling such polishing.

Typically, integrated circuits are provided as "chips", each of which includes a slice of a flat material that has the specific circuitry. A multiple number of the desired integrated circuits are formed at the same time by etching and coating a disk-shaped semiconductor wafer substrate. The wafer is then diced into flat rectangles which are individually provided with suitable packaging having the necessary leads to electrically access the integrated circuitry. In certain instances a full wafer is used to form a single integrated circuit rather than duplicates of a desired integrated circuit.

The disk-shaped wafer substrates typically are comprised of a monocrystalline semiconductor, such as single crystal silicon. One common method of forming the wafer is to grow a relatively long cylinder or log of a single crystal of the material, and then slice the log (often called a boule) to form the individual disk-shaped wafers.

It is necessary for the formation of various circuits or for other uses of wafers, that the active or front face, e.g., the face of the wafer on which the integrated circuitry is to be formed, be highly polished. (The other side of the wafer is often referred to as the wafer "back" face.)

At the beginning of a chemical mechanical polishing (CMP) step for ILD (inter-layer dielectric) planarization at time $t_0$, the difference in top surface height, $h_{initial}$, between the field region and areas of dense device features may be as large as 0.8 to 1.0 micro meter. Pre-CMP semiconductor thickness measurements arc used to determine the polishing time ($t_{final}$) for each wafer based on calibrations established in the development stage. At time $t_0$, the polisher starts to remove material, typically at a rate of 1–3 kA/minute, but faster on features that are smaller and isolated, and more slowly on features that are larger or in densely packed areas.

Polishing continues through until time ($t_{final}$) when the wafer is removed from the tool, cleaned, and measured afterwards to confirm that an acceptable final thickness ($t_{final}$) was achieved.

The final thickness measurement is an important moment for CMP metrology. The time ($t_{final}$) is selected from a CMP polisher calibration based on applied pressure, rotation speed, average pad life degradation, pressure, etc., to produce a ($t_{final}$) centered within the allowed semiconductor wafer process window. However, dynamic factors may alter the actual thickness ($T_{true}$) realized at time ($t_{final}$). If the material removed by time ($t_{final}$) exceeds the limit, the wafer must be scrapped or more dielectric must be deposited. If the remaining thickness is excessive, the wafer can be returned to the polisher for rework. This above-described loop characterizes the basic CMP method today.

The CMP process window is defined as the difference between the Upper And Lower Thickness Limits (TUL and TLL). The CMP tool design must completely eliminate malfunctions that can cause large thickness errors.

During semiconductor wafer fabrication, silicon is plasma-etched to form device islands, then thin oxide and silicon nitride layers are deposited. Dielectric material (TEOS) is deposited to fill the spaces between the islands and build up a thick dielectric over-layer. CMP tools then planarize the upper surface of this dielectric layer, eventually polishing through the TEOS and exposing the underlying SiN at some locations. Since SiN has a removal rate several times smaller than oxide, the polishing slows at the exposed locations, allowing slower areas to "catch-up" for improved planarity.

Since the SiN removal rate is smaller but still non-zero, it is important to measure the thickness of the remaining oxide and nitride simultaneously. Otherwise, the remaining SiN layer could become too thin at the location where the polish is fastest.

Other semiconductor wafer CMP operation issues include global planarity which are dominated by the "macro" effects of the polisher pad, wafer head chucking device, polish pad velocity, polishing pad age and conditioning, etc. Uniformity from wafer center to wafer edge is the usual metric. Across-the-wafer uniformity is also influenced by boundary effects at device edges, at the wafer edge. CMP tools must provide thickness measurement that can accommodate custom spaced measurements of chosen length and point density in diameter or radius scan format. CMP operations on semiconductor device features with large spatial separations reveal several surprising effects.

First, an effect known as the "edge effect" can cause a thicker oxide in the outer 5–15 mm of the wafer. The excess thickness can range from 1–4 kA depending on the manner in which the wafer is held in the polishing carrier. A second unexpected effect visible in the figure is the oscillation in thickness across the wafer. This 100–200A variation occurs because the CMP TEOS polishing rate is faster in the kerf area adjacent to the test die than in the kerf intersection areas.

Within-die planarity is influenced by the tendency of CMP to polish smaller, individual features faster, and larger and densely-packed features more slowly. The oxide removal rate over features of 15 micro meter width was 60–80% greater than over features of 65 micro meter width under high throughput conditions. This effect introduces considerable complexity, given the differences in pattern density that occur on IC devices.

CMP processing reaches an asymptotic limit in the microplanarity regime, where polishing occurs largely by smoothing and filling-in between the dense, small features, rather than by direct removal of material from larger spacing.

These effects concerning semiconductor device feature size subsequently drive a subordinate requirement that CMP tools automatically perform a sequence of semiconductor wafer film thickness measurements and manage the data from different semiconductor device features accordingly. Each semiconductor device site job file becomes a chain of individual measurements, each with its own location, measurement recipe, pattern recognition model, and data format.

The semiconductor wafer film thickness measurement data generated may be needed in processing according to device feature type and size, as well as locations on the wafer. The CMP tool operator must simultaneously keep within limits the thickness at the smallest, fastest-polishing feature within the fastest-polishing die on the wafer, and at the largest, slowest-polishing feature in the slowest polishing die on the wafer.

To this end, chemical mechanical polishing machines have been designed to provide the desired semiconductor device film thickness. The machine typically brings the device face of the wafer to be polished into engagement with a polishing surface such as the polishing surface of a pad having a desired polishing material, e.g., a slurry of colloid silica, applied thereto.

The movement between the wafer and the polishing pad provides the polishing As forces. In some instances, this "polishing" is provided primarily for the purpose of making one face flat, or parallel to another face. In this connection, it must be remembered that the wafer itself is microcrystalline and characteristics of this type may be quite important in making the wafer suitable for the production of integrated circuitry or for some other desired use.

An abrasive, proportionately dispensed in the slurry, provides the cutting action when the wafer is engaged by pressure and placed in contact with a polishing pad laden with the slurry/abrasive mixture, and then caused to move laterally relative to the polishing pad. It is further recognized that the repeated engagement of the faces of numerous wafers moving against the polishing pad will result in a wearing out of the polishing pad over a described period of time. The resultant wearing out of the polishing pad therefor has an undesirable effect on the consistency of the surface finish of the wafer prescribed under the terms of Preston's equation, since, in general, a longer polishing time on a worn polishing pad will be required to achieve the same thickness of removal that can be accomplished on a new polishing pad in a significantly shorter time.

Preston's equation states:

$$\text{Removal Rate}=(\Delta^m/\Delta_t)=\Delta^m t=[(K_P(P*V)*(A/A_c,*\Delta_t^2)]$$

whereas:

$\Delta^m$ = The total material removed,
$\Delta_t$ = The polishing time,
$\Delta^m t$ = The material removal rate,
$K_p$ = Preston's constant,
P = The applied pressure between the wafer and polishing pad,
V = The relative velocity between the wafer and polishing pad,
A = Wafer contact area are all component terms of Preston's constant.
Ac = Instantaneous device cut area.

Further it is understood the term $K_P$ (Preston's constant) is composed of the complex parameters $K_a$ and $K_b$, wherein:

$K_a$ is the roughness and elastic constant of the polishing pad, and $K_b$ is the complex term for the surface chemistry and abrasive material used in the slurry.

Accordingly, there is a need for a control or compensation for constantly varying results which are achieved over time during a polishing series, given a fixed set of polishing variables, due to degradation of the polishing surface and polishing media, among other variables.

DISCLOSURE OF THE INVENTION

It is an object of the present invention to provide a chemical mechanical polishing system that first measures an unprocessed semiconductor wafer, $t_{initial}$, then during the subsequent CMP operation, statistically corrects for the resultant wearing out of the semiconductor wafer polishing pad. This is accomplished by a first wafer thin film measurement means which provides $t_{initial}$, then performing a correction/learning CMP operation on said wafer by feeding forward the amount of film to be removed during said CMP with a linear prediction and estimation factor constructed from previously performed wafer CMP operations including a ($t_{final}$) thickness measurement on said previous semiconductor wafer. This operational sequence thus nullifies the undesirable effects of film consistency variations on the device surface of said semiconductor wafer.

Another object of this invention is to provide a method and apparatus for a computer controlled function, sampling the data from an external thin film thickness measurement device and adding a statistical signal processing algorithm using analysis and prediction of the current and future removal rates based on performance of past ratios of the before and after CMP processing of semiconductor film thickness readings.

Further, it is yet another object of this invention to have a chemical mechanical polishing system that statistically corrects for the resultant transformation of the polishing characteristics of the polishing system by the use a linear estimation factor thus nullifying the undesirable effects of said polishing pad non-consistency upon the surface finish of the wafer. This algorithmic procedure provides a chemical mechanical polishing system a stable means of removal control for a specific thickness dimension of certain layered materials from the uppermost overlay of a semiconductor wafer.

These and other objects of the invention will become apparent upon referencing the descriptions, drawings, and detail of the preferred embodiments herein.

Thus, a method for controlling thickness removal of a substrate during polishing of a series of n substrates, where n is a positive integer greater than one is disclosed to include: measuring a thickness of a first substrate prior to polishing; polishing the first substrate for a predetermined time; measuring the thickness of the first substrate after polishing; determining an actual thickness removal rate, based on the measurement before, the measurement after and the predetermined time; and applying a linear estimation factor, based on the actual thickness removal rate, to form an adjusted polishing time for a subsequent substrate to be polished, to adjust for degradation and inconsistency of a polishing surface that occurs during the polishing of multiple substrates.

Further, the method includes measuring a thickness of the subsequent substrate prior to polishing; polishing the second substrate for the adjusted polishing time; measuring the thickness of the subsequent substrate after polishing; determining an actual thickness removal rate, based on the measurements of the subsequent substrate before and after polishing and the adjusted polishing time; and applying a linear estimation factor, based on the actual thickness removal rates of previously polished and measured substrates, to form an adjusted polishing time for a subsequent substrate to be polished, to adjust for degradation and inconsistency of a polishing surface that occurs during the polishing of multiple substrates.

This process is repeated for subsequent substrates up to n. The linear estimation factor is disclosed as taking into account measurement and polishing data of up to ten previous substrates for forming a linear estimation factor for the next subsequent substrate to be polished. Preferably, the estimation factor is determined using a Yule-Walker algorithm, although other algorithms may possibly be used.

Preferably, the polishing process is a chemical mechanical polishing process, although the invention may be applied to other polishing processes. The adjustment of polishing time according to the linear estimation factor compensates for polishing pad inconsistencies over the course of polishing a series of substrates.

An apparatus for controlling thickness removal of substrates during polishing of a series of substrates is disclosed to include: a polisher having a polishing surface, a substrate carrier for pressing a substrate against said polishing surface with a controlled pressure, and at least one driver for moving the substrate carrier and substrate along the polishing surface to effect a polishing of the substrate; a thickness measuring device for measuring a thickness dimension of the substrate before and after polishing; and means for determining an actual thickness removal rate, based on the measurements of the substrate before and after polishing and a time of polishing the substrate, and for determining a linear estimation factor, based on the actual thickness removal rate, to form an adjusted polishing time for a subsequent substrate to be polished, to adjust for degradation and inconsistency of a polishing surface that occurs during the polishing of multiple substrates.

Preferably, the polisher is a chemical mechanical polisher and the polishing surface includes an abrasive slurry. Preferably the substrates to be polished are semiconductor wafers.

Finally, an apparatus for compensating for polishing surface degradation is disclosed to include a thickness measuring device for measuring a thickness dimension of a substrate to be polished both before and after polishing; and means for determining an actual thickness removal rate, based on the measurements of the substrate before and after polishing and a time of polishing the substrate, and for determining a linear estimation factor, based on the actual thickness removal rate, to form an adjusted polishing time for a subsequent substrate to be polished, to adjust for degradation and inconsistency of a polishing surface that occurs during the polishing of multiple substrates.

BEST MODE FOR CARRYING OUT THE INVENTION

Figure 1:
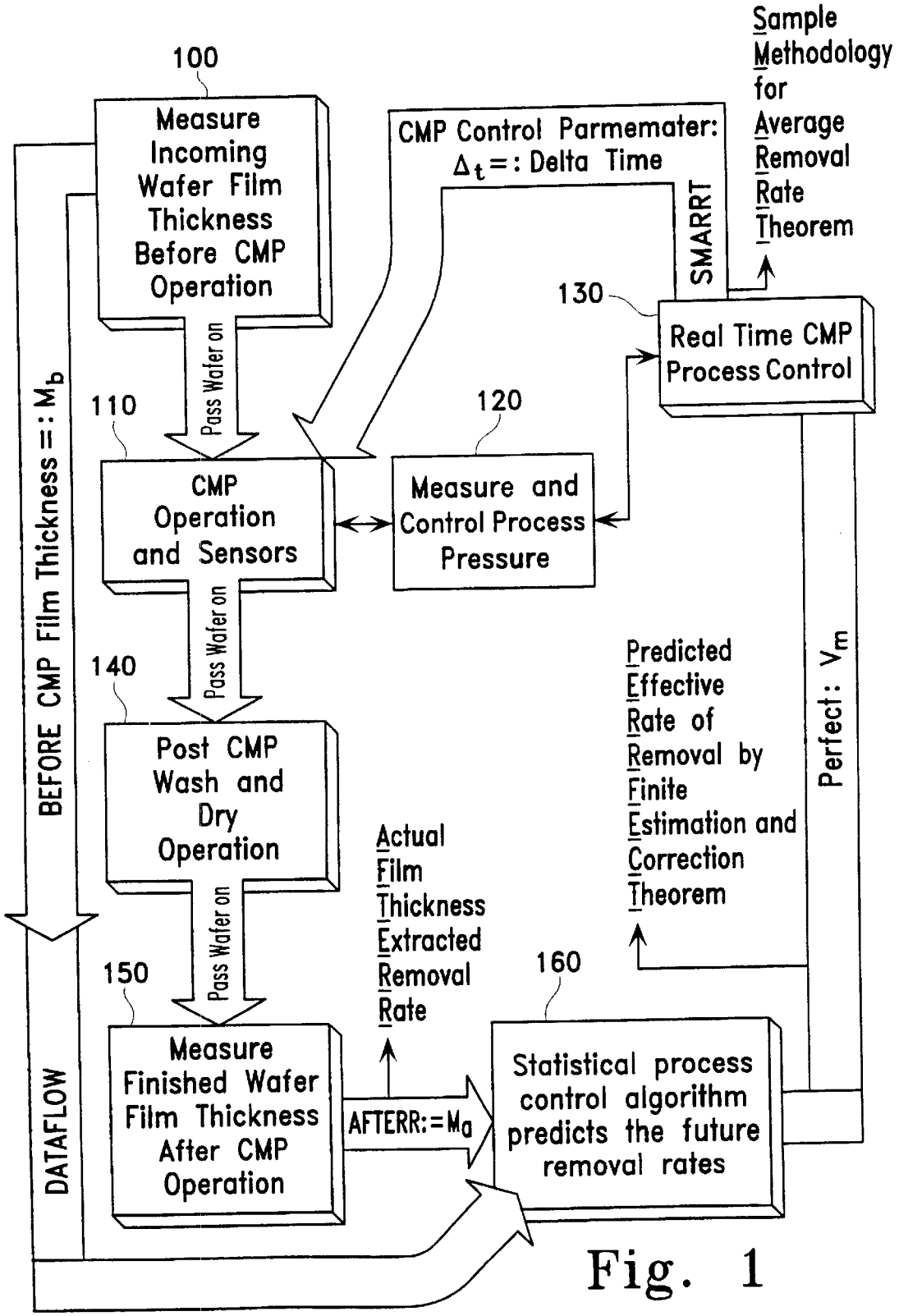
FIG. 1 is a flow chart showing a polishing operation employing a method for controlling thickness removal according to the present invention.

A preferred process for standardizing an amount of thickness removal from semiconductor wafers is illustrated in the flow chart of FIG. 1. Although the preferred embodiment is directed to chemical mechanical polishing of semiconductor wafers, it is noted that the present inventive method may be more broadly applied to chemical mechanical polishing of other substrates, such as hard disk, and other polishable surfaces, and even more generally, to other polishing processes not involving chemical mechanical polishing.

Figure 6:
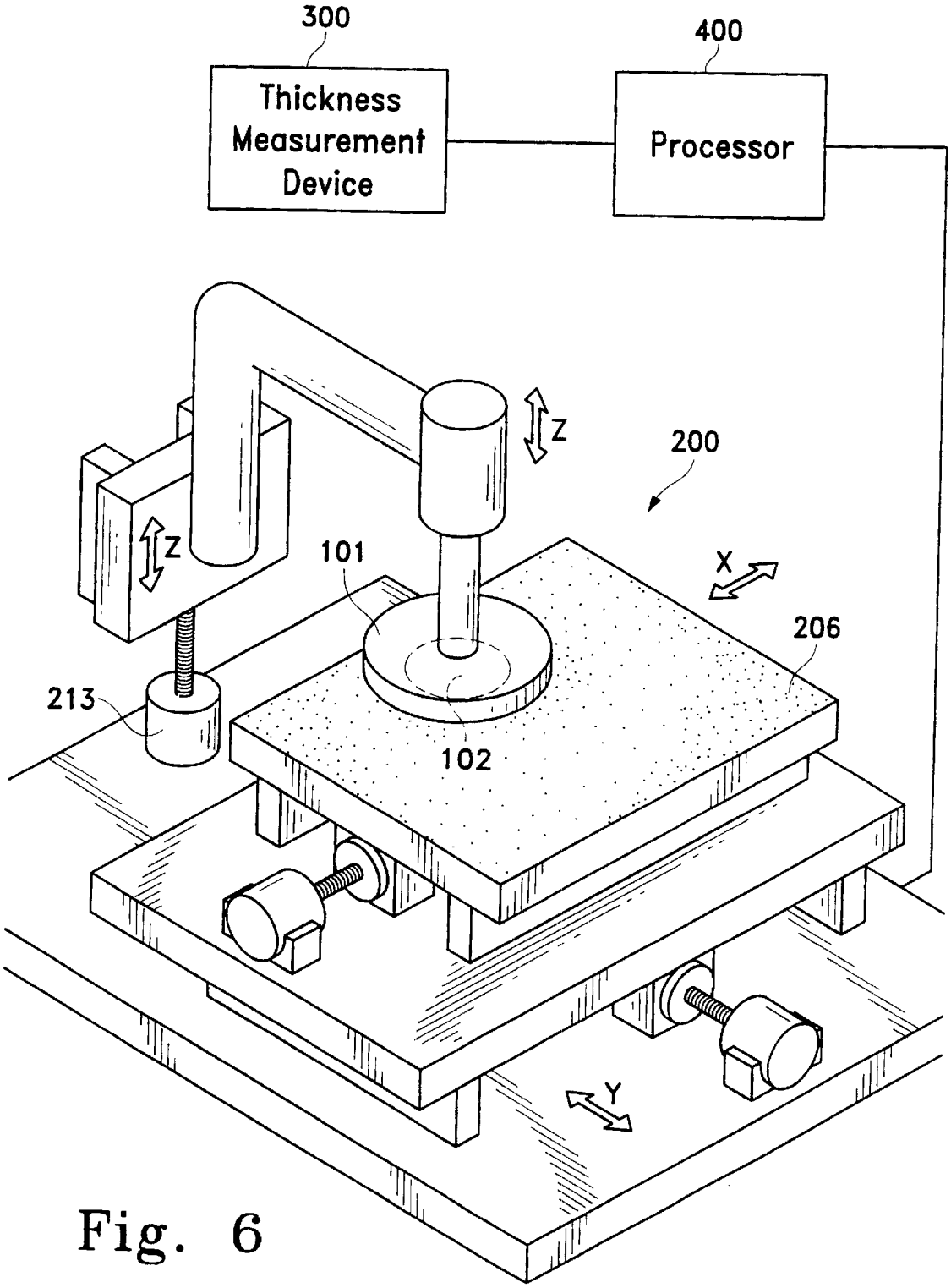
FIG. 6 is a perspective view of a chemical mechanical polishing machine in combination with schematics showings of a thickness measurement device and processor according to the present invention.

Prior to polishing a wafer, a "before thickness" of the wafer is measured (100). More particularly, in the preferred embodiment, a thin film measurement is made on the wafer, of a layer to be polished. Such measurement may be performed by a number of available devices, such as a white light interferometer provided by Tencor of Milpitas, Calif. Another acceptable device is produced by Nova Instruments of Israel. FIG. 6 schematically illustrates a thickness measurement device (300) used both before and after polishing with an exemplary CMP polishing apparatus (200), to measure a film thickness of wafer (102). As noted, the CMP polishing device is merely one example of a CMP polisher for use in the present invention, and is disclosed in application Ser. No. 08/443,956 in detail, as are other embodiments. Nor is the present invention limited to only those embodiments disclosed in application Ser. No. 08/443,956, but may be applied to CMP polishers in general, and particularly those for with which the pressure between the wafer and polishing pad, the relative velocity between the wafer and the polishing pad, and the contact are of the wafer with the polishing pad are held substantially constant.

After making a thickness measurement on the wafer (102) to be polished, the wafer is mounted in a carrier (101) and applied to a polishing surface (206) (see FIG. 1, (110)) for polishing the face of the wafer (102). The wafer (102) is polished for a predetermined time designed to remove a predetermined thickness off the face of the wafer (102). During polishing, the pressure applied by the wafer (102) against the polishing surface (206) is measured and controlled (120) through sensors which are provided on the polishing apparatus (200). Pressure control is preferably done in real time (130) using a microprocessor arrangement with feedback control over a Z-direction driver (213), such as that disclosed in application Ser. No. 08/443,956, for example.

After completion of the polishing of wafer (102), the wafer is washed and dried (140), and an "after polishing" thickness measurement (150) of the wafer (102) is performed using thickness measurement device (300). Both the "before" and "after" thickness measurements of the wafer (102) are compared to determine the material thickness removed and the material removal rate, as described below. These values are then used to alter the processing parameters, preferably the polishing time, of the next wafer to be polished with the goal of removing the same thickness of material from the next wafer. In the preferred embodiment, inputs from up to ten previous wafers can be considered in determining a factor by which to alter the polishing time of a subsequent wafer to be polished.

The use of a predicted CMP sequence correction polynomial (functions below) generate coefficients for an $N^{th}$ order linear correction method from sampled sequences. The predicted CMP sequence characterization polynomial and compensation technique is composed of two parts:

1. Actual Film Thickness Existential Removal Rate (AFTERR); and
2. Predicted CMP sequence Characterization; the Predicted Effective Rate of Removal by Finite Estimation and Correction Theory. (PERRFECT) characterization.

Depending on peculiarities common to a particular yielded manufacturers' polishing pad media, a combination of various process priming techniques are used to start a lot-size batch process that will exemplify the polishing system irregularities. This process priming technique allows the PERRFECT characterization to mathematically describe the difference between the first, semiconductor film thickness before the chemical mechanical polishing operation then second, the semiconductor film thickness after the chemical mechanical polishing operation as the actual removal rate, AFTERR, of the system. Polishing system media irregularities are subsequently tracked and the corresponding information is characterized by the PERRFECT polynomial.

As noted above, the "Material Removal Rate" is defined by subtracting the previously processed wafer's actual material film thickness from the wafer material thickness measured before polishing (i.e. the "after polishing" term $M_a$ is subtracted from the "before polishing" term $M_b$ The resultant numerical term: material thickness removed ($\Delta^m$) is accordingly divided by the process time $\Delta_t$. This provides a semiconductor material thickness removal rate term within a numerical per second basis $\Delta_t$.

$$\text{Material Removal Rate}=: \Delta^m_t=(M_b-M_a)/\Delta_t$$

Whereas:

$M_b$ =: Wafer material thickness BEFORE CMP operation, in Angstroms.
$M_a$ =: The wafer material film thickness AFTERR CMP operation, in Angstroms.
$\Delta_t$ =: The total CMP operation time from Start to Finish, in seconds.
$\Delta^m$ =: The Total numerical material thickness removed during the CMP operation, in Angstroms.
$\Delta^m_t$ =: The numerical material thickness removal rate, in Angstroms per seconds.

The PERRFECT characterization polynomial, ($y_m$), provides for the terms ($\Delta_t$*$y_m$)—wherein the variable term ($y_m$) provides correction control of $\Delta_t$, the total CMP time. The total time of the chemical mechanical polish process is used as the control variable term within a sampled data control system—where $(\Delta^m/\Delta_t)=\Delta^m_t$ is the numerical material thickness removal rate, in Angstroms per second. Thus:

$$\text{Numerical Material Removal Rate}=|\Delta^m_t|=: (\Delta^m/\Delta_t)=[(K_P(P*V)*(A/A_c*\Delta_t^2)]\text{in Angstroms per second.}$$

wherein:

$\Delta_t$ =: The total polishing time, in seconds.
$\Delta^m$ =: The total semiconductor material removed, in Angstroms.
$\Delta^m t$ =: The material removal rate, in Angstroms per second.
$K_P$ =: Preston's constant, in unit terms.
P =: The applied pressure between the wafer and polishing pad, in pounds per square inch.

-continued

V =: The relative velocity between the wafer and polishing pad, in meters per second.
A =: The contact area of the wafer/polishing pad.
Ac =: Instantaneous device cut area.
$y_m$ =: The predicted correction term (PERRFECT) corrects for structural component drift within the complex terms of the surface chemistry, abrasive material roughness, and elastic constant of the polishing pad that actualize the complex composition for the term $K_P$.

$$[(\Delta_t*y_m)*(K_P)]=0.$$

It is further understood that the term $K_P$ is composed of complex parameters $K_a$, $K_b$, and A, wherein:

$K_a$=: The roughness and elastic constant of the polishing pad, and $K_b$=: The complex term for the surface chemistry of the abrasive material.

It is another function of this chemical mechanical polishing invention to hold constant the following terms:

P, the applied pressure between the wafer and polishing pad,

V, the relative velocity between the wafer and polishing pad, and

A, the contact area of the wafer/polishing pad.

The flow chart as shown in FIG. 1 provides a chemical mechanical polishing system a stable means of removal control for a specific thickness dimension of certain layered materials from the uppermost overlay of a semiconductor wafer:

In accordance with this invention the correction for the variable term $K_P$ (with its complex parameters $K_a$ and $K_b$), are the variables for which $\Delta_t$, the modifier term, are altered by the predicted CMP sequence characterization polynomial PERRFECT term, $y_m$.

This term is given as follows:

$$y_m = -\left[\sum_k D_k \cdot (m-k \geq 0) \cdot \text{Pad_Wear_Sample}_{m-k}\right.$$

wherein:

D=yulew(sample, N)

Thus, the predicted CMP sequence characterization polynomial (PERRFECT) is a form of the Yule-Walker algorithm, as noted in *Note: Reference Optimum Signal Processing*, by Sophocles J. Orfanidis (published by Macmillan, 1988).

The following algorithmic procedure provides a chemical mechanical polishing system a stable means of removal control for a specific thickness dimension of certain layered materials from the uppermost overlay of a semiconductor wafer.

Predicted Effective Rate of Removal by Finite Estimation and Correction Theory, (PERRFECT)

The two functions below generate coefficients for an Nth order linear prediction from a sample sequence. In Nth order linear prediction of a signal x, the predicted value of $x_n$ is computed from earlier values by the sum:

$$k = 1 \ldots N \qquad x_n = \sum_k -a_k \cdot x_{n-k}$$

The prediction is carried out by estimating the coefficients $a_k$ from a sample s of the sequence. These functions herein implement a method for estimating the coefficients, the Yule-Walker algorithm.

$$bn = 2 \cdot gaussn(1008)\ X_i = \left[\left(\cos\left(\frac{2 \cdot \pi \cdot i}{2000}\right) + rnd(.2) + .8\right) \cdot 2\right] + 96$$

Thus, in FIG. 1, the "before" and "after" measurements are used to determine a correction term $y_m$ to be applied for modification of the polishing time of the next wafer to be polished. Although the above algorithm could be computed by hand, a processor (400) is preferably employed to run the above described statistical process control algorithm. As shown in FIG. 6, the processor (400) is preferably the same processor used for the real time control of pressure and other process variables of the polishing apparatus 200.

EXAMPLE

Figure 2:
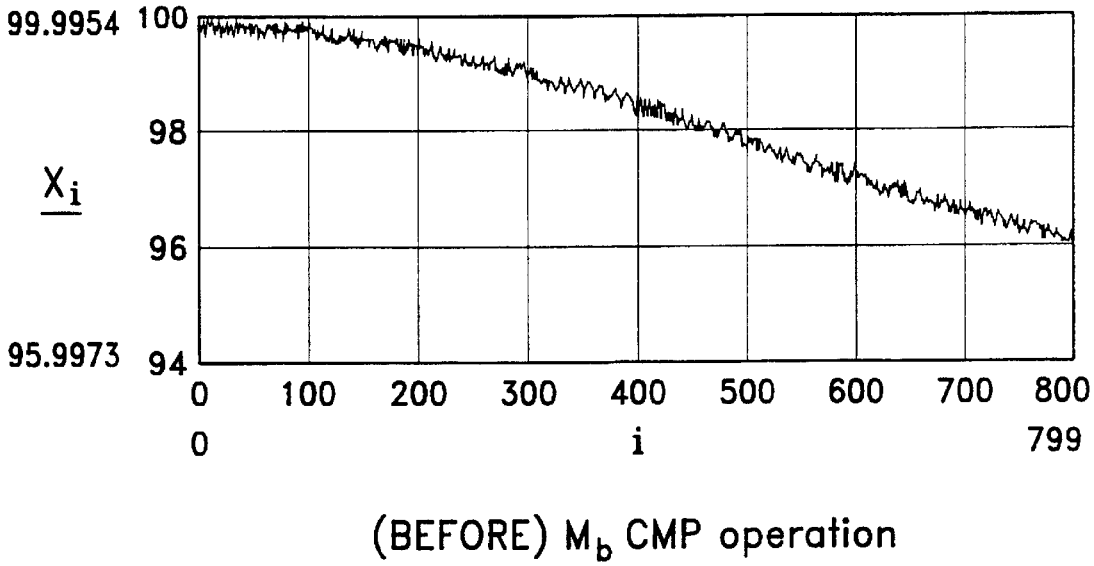
FIG. 2 shows the relationship between a sample set of wafers processed and the simulated wafer material thickness, $M_b$.

As an example, FIG. 2 shows a simulated Wafer material thickness (BEFORE) $M_b$ CMP operation, in Angstroms, generated by this series:

Number of Sample Wafers: M=800 $sample_i$=X Yule Walker:=

$$\min \varepsilon = \left[\sum_{n=0}^{n+p-1} e_p + n^2\right]$$

i=0 . . . M−1

Prediction order: N=10

Compute the coefficients using Yule-Walker:

D yulew(sample, N)

In this example the D coefficients of N are:

| | 0 |
|---|---|
| 0 | 1 |
| 1 | −0.998 |
| 2 | −0.004 |
| 3 | 0.003 |
| 4 | 0.002 |
| D = 5 | −0.004 |
| 6 | 0.004 |
| 7 | −0.002 |
| 8 | $3.812 \cdot 10^{-4}$ |
| 9 | $-5.562 \cdot 10^{-4}$ |
| 10 | 0.001 |

The coefficients are used to predict the next value in the sequence from a set of n consecutive values, the first through nth elements of the coefficient vector D are used, ignoring the zeroeth element, which is always 1. It is noted that "1" is needed when we use D (Yule-Walker) as a prediction error filter to generate the complete set of prediction errors.

The predictions for the first M+N steps, assumes that the sample sequence is padded with 0's at each end, whereby the first predicted value is always 0.

$$m=1 \ldots (M-N)-1\ k=1 \ldots N-1$$

Start with 0 padding=: $y_0 0$

CMP_Sequence=sample

Finish with 0 pad=: CMP_Sequence M+N−1:=0

The predicted correction term is=

$$y_m = -\left[\sum_k D_k \cdot (m \cdot k \geq 0) \cdot \text{CMP_Sequence}_{m-k}\right]$$

Figure 3:
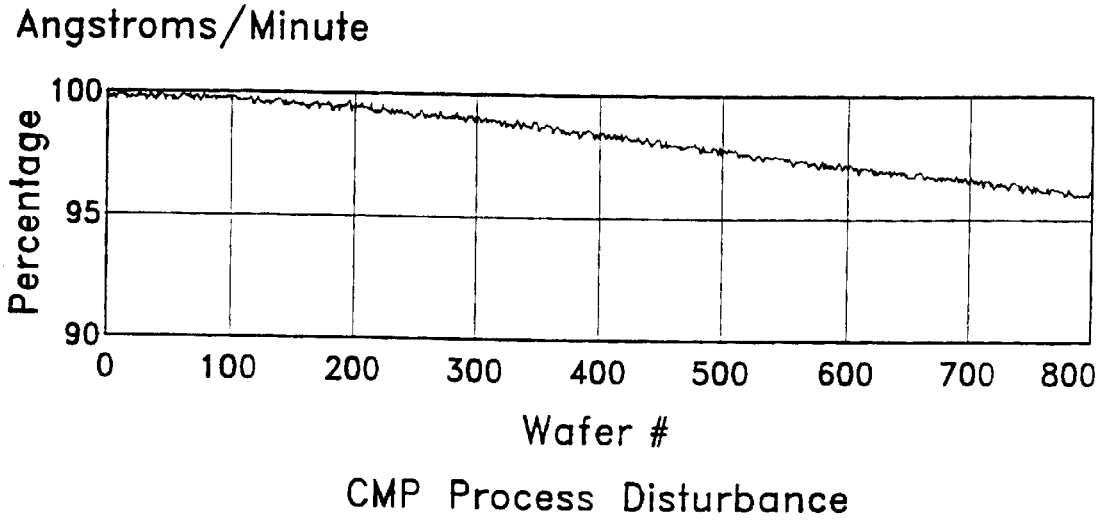
FIGS. 3 and 4 show the close matching relationship between predicted correction and actual values with the method of the present invention.
Figure 4:
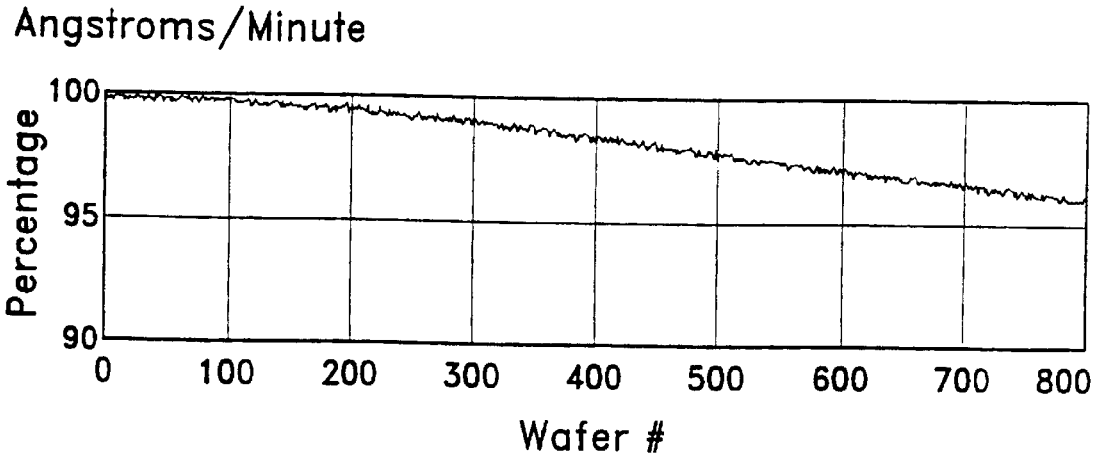

The predicted correction and actual values are plotted below in FIGS. 3 and 4. The prediction error coefficients are generated by using the coefficient array D as a filter, and computing the response of the sample.

Figure 5:
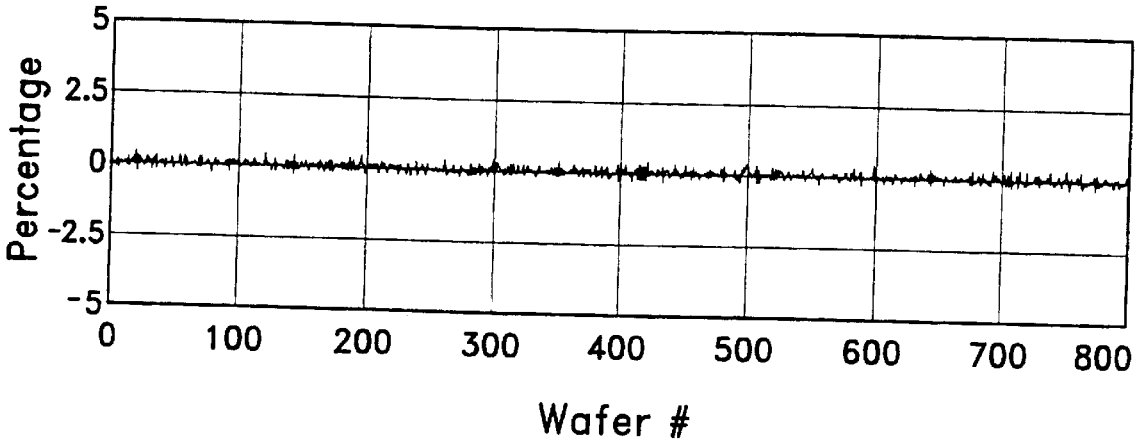
FIG. 5 visually shows the "closeness" of the match given in FIGS. 3 and 4.

The full coefficient array is called the CMP prediction-error filter.

$$PE_m = (y_m) - (CMP_\text{Sequence}_m)$$

which is depicted in FIG. 5.

It is noted that because the sample has been zero-padded, the predictions at the ends of the ranges are by design necessarily poor.

This example shows that "PERFECT" corrections do indeed give the difference between the two graphs on the preceding screen. For example:

$PE_{45}$=−0.204801

$CMP_Sequence_{45} - y_{45}$=0.204801

It is noted that the concept of a statistical process algorithm according to the present invention is not limited to the use of the Yule-Walker algorithm described in detail above, but that the present invention could be practiced using other predictive statistical process algorithms, such as the Burg algorithm, for example. Further, as also previously noted, the present invention is not limited only to chemical mechanical polishing of semiconductor wafers, but may be applied to polishing of other types of substrate and other polishing methods.

Although there have been described above specific methods and systems for controlling thickness removal of substrates during chemical mechanical polishing, with a limited selected number of alternative embodiments in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as set forth in the claims which follow.

What is claimed is:

1. A method for controlling thickness removal of a substrate during polishing of a series of n substrates, where n is a positive integer greater than one, the method comprising:

measuring a first thickness of a first substrate prior to polishing;

polishing the first substrate for a predetermined time;

measuring a second thickness of the first substrate after polishing;

determining an actual thickness removal rate based on the first thickness, the second thickness and the, predetermined time; and forming an adjusted polishing time for a subsequent substrate to be polished to adjust for degradation and inconsistency of a polishing surface that occurs during polishing of multiple substrates, wherein forming an adjusted polishing time comprises applying a Yule-Walker algorithm to determine a linear estimation factor based on the actual thickness removal rate.

2. The method of claim 1, further comprising:

repeating the procedures recited in claim 1 for subsequent substrates up to n.

3. The method of claim 1, wherein the polishing steps comprise chemical mechanical polishing.

4. An apparatus for controlling thickness removal of substrates during polishing of a series of substrates, comprising:

a polisher having a polishing surface, a substrate carrier for pressing a substrate against said polishing surface with a controlled pressure, and at least one driver for moving the substrate carrier and substrate along said polishing surface to effect a polishing of said substrate;

a thickness measuring device for measuring a first and second thickness dimension of the substrate before and after polishing, respectively; and a processor adapted to determine an actual thickness removal rate based on the thickness of the substrate before and after polishing and a time of polishing the substrate, and a linear estimation factor based on the actual thickness removal rate to form an adjusted polishing time for a subsequent substrate to be polished to adjust for degradation and inconsistency of a polishing surface that occurs during the polishing of multiple substrates, wherein the linear estimation factor is determined using a Yule-Walker algorithm.

5. The apparatus of claim 4, wherein the processor is adapted to:

repeat the procedures recited in claim 4 for subsequent substrates up to n.

6. The apparatus of claim 4, wherein the polisher comprises a chemical mechanical polisher.

* * * * *

UNITED STATES PATENT AND TRADEMARK OFFICE

CERTIFICATE OF CORRECTION

PATENT NO. : 6,594,542 B1
DATED : July 15, 2003
INVENTOR(S) : Williams

It is certified that error appears in the above-identified patent and that said Letters Patent is hereby corrected as shown below:

Column 1,
Line 58, please change “arc” to -- are --.

Column 3,
Line 25, please change “polishing As forces” to -- polishing forces. --.

Column 9,
Line 60, please change “(M - N)” to -- (M + N) --.
Line 63, please change “$y_0$0” to -- $y_0 = 0$ --.

Signed and Sealed this

Twenty-third Day of December, 2003

JAMES E. ROGAN
*Director of the United States Patent and Trademark Office*